United States Patent [19]

Locke

[11] 4,123,130

[45] Oct. 31, 1978

[54] REFRIGERATOR APPARATUS

[76] Inventor: Lillian Locke, 20 Harmony Rd. South, Oshawa, Ontario, Canada, L1H 6T1

[21] Appl. No.: 885,506

[22] Filed: Mar. 13, 1978

Related U.S. Application Data

[63] Continuation of Ser. No. 706,170, Jul. 19, 1976, abandoned.

[51] Int. Cl.[2] ..... A47B 81/00

[52] U.S. Cl. ..... 312/285; 312/236

[58] Field of Search ..... 312/236, 283, 285; 62/440; D15/79, 81, 85, 86, 87, 89, 91

[56] References Cited

U.S. PATENT DOCUMENTS

| | | | |
|---|---|---|---|
| D. 148,212 | 12/1947 | Boyce | D15/86 |
| 940,416 | 11/1909 | Young | 312/283 X |
| 1,291,366 | 1/1919 | Banks | 312/236 |
| 2,541,848 | 2/1951 | Vetter | 312/236 X |
| 2,588,563 | 3/1952 | Paul | 312/236 X |
| 2,613,123 | 10/1952 | Patten | 312/236 X |
| 2,811,020 | 10/1957 | Formoso | 312/285 X |

*Primary Examiner*—Mervin Stein
*Assistant Examiner*—David H. Corbin
*Attorney, Agent, or Firm*—Robert D. Farkas

[57] ABSTRACT

This disclosure pertains to a refrigerator housing having at least two access doors hingably affixed thereto on adjacent vertical exterior surfaces. A plurality of rotatable shelves are disposed intermediate or adjacent to the door openings providing convenient access for articles of food stored on the rotatable shelves and on arcuately shaped shelves adjacent thereto. A drawer, slidably affixed to the housing, is located over the storage areas associated with the rotatable shelves. A freezer compartment, having a hinged door panel, is accessible in the uppermost regions of the housing.

7 Claims, 4 Drawing Figures

REFRIGERATOR APPARATUS

This is a continuation application of Ser. No. 706,170 filed on July 19, 1976, now abandoned.

BACKGROUND OF THE INVENTION

1. Field of the Invention

This invention relates to a refrigerator apparatus and more particularly to that class having rotatable shelves therewithin.

2. Prior Art

The prior art abounds with refrigerators utilizing shelves that rotate. U.S. Pat. No. 2,051,271 issued on Aug. 18, 1936 to C. E. Passmore teaches a plurality of circular shelves being simultaneously rotated by an electric motor apparatus and being housed within a refrigerator enclosure having a semi-circular door.

U.S. Pat. No. 2,680,668 issued on June 8, 1954 to C. A. Stanfiel discloses a plurality of circular shelves adjustably fixedly secured to a shaft. The shaft is disposed in a vertical direction, within the cylindrical interior of a refrigerator housing.

U.S. Pat. No. 2,803,513 issued on Aug. 20, 1957 to P. E. Davey pertains to a semi-circular shaped series of stacked shelves rotatably affixed to a vertical column disposed within a refrigerator housing having semi-circular interior walls.

All of the aforementioned patents suffer the common deficiency of providing an interior surface of the housing which is disposed in circular fashion about all or a portion of the marginal edges of the circular or semi-circular shelves. Accordingly, maximum utilization does not occur of the space which the refrigerator partially utilizes or the interior useful volume of the refrigerator is substantially less than the external volume of those refrigerators whose cross-sections are rectangular in shape.

SUMMARY OF THE INVENTION

A primary object of the present invention is to provide a refrigerator having rotating circular shelves whose volumetric storage capacity closely approximates the overall volume of the refrigerator.

Another object is to provide a refrigerator with access doors on the sides thereof.

Still another object is to provide a refrigerator having a pull-out drawer portion which is useful for the storage of foods requiring close confinement, separated from other storage area of the refrigerator.

Heretofore, refrigerators having circular shelves paid the price of minimal storage capacity for the volume occupied by the refrigerator whilst gaining convenience in accessibility to the foodstuff items stored on the shelves. Often times the interior surfaces of the compartment housing the circular shelves were equipped with curves closely approximating the marginal edges of the shelves so as to prevent foodstuffs from falling off the shelves as they were being rotated. The present invention eliminates these problems and further provides a pull-out style drawer disassociated from the compartment containing the rotating shelves so as to provide easy access to the foodstuffs stored therewithin.

These objects, as well as other objects of the present invention, will become more readily apparent after reading the following description of the accompanying drawings.

DETAILED DESCRIPTION OF THE PREFERRED EMBODIMENT

The structure and method of fabrication of the present invention is applicable to a refrigerator divided into three major compartments. The lowermost compartment has an interior volume generally disposed in rectangular cubical form and is accessible through a large hinged door disposed on the frontmost exterior surface of the housing. A pair of smaller doors, being disposed on sides of the enclosure adjacent to the side carrying the large door, provide access to the lower compartment nearest the rear face of the housing and on each side of the interior volume unoccupied by the circular shelves. Tne front door is adapted with a matching shelf for each rotating shelf and has a circularly shaped wall which is disposed adjacent a portion of the marginal edges of the shelf when the front door is closed. Each of the side doors expose removable trays, each having walls which nest adjacent to the marginal edges of the circular shelves. The combined surface area of one circular shelf and the shelf adjacent thereto fastened to the front door and the two removable trays adjacent to the marginal edges of the circular shelf substantial equal the toral area of a horizontal cross-section of the interior portion of the lower compartment. The storage efficiency and the ability to retain foodstuffs on the circular shelf are thus substantially enhanced.

Since certain foods such as vegetables and fish and the like should not be stored in the main lowermost storage compartment, a drawer is provided, which has a plurality of separate compartments and which is slidably removably stored within a compartment disposed above the lower compartment, having the capability of being withdrawn from the housing, passing through the frontmost surface of the housing. The uppermost compartment is utilized as a freezer and is accessible by way of a door panel, hingably secured to the front panel of the enclosure.

Figure 1:
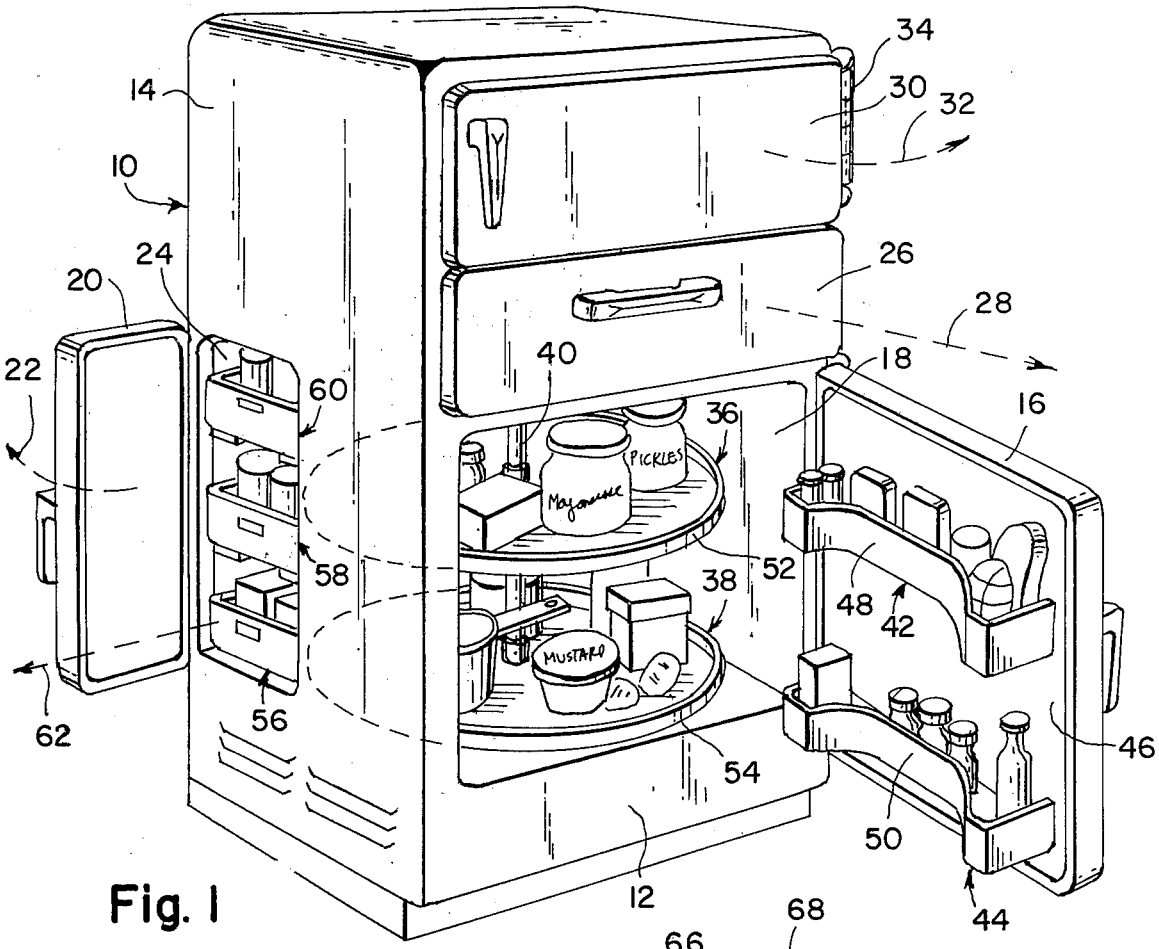
FIG. 1 is a perspective view of the present invention.

Now referring to the Figures, and more particularly to the embodiment illustrated in FIG. 1 showing refrigerator enclosure 10 having a frontmost panel 12 and a side panel 14 adjacent thereto. Lowermost front door 16 exposes access port 18 when hingably opened, as shown, Side door 20 hinges in the direction of arrow 22 to an open position as shown, exposing access port 24 thereby. Drawer 26 may be slidably disposed outwardly from frontmost panel 12, in the direction of arrow 28. Uppermost panel 30 may be hingably disposed in the direction of arrow 32 by utilizing hinge 34 so as to provide access to a freezer compartment therebehind, not shown.

The lowermost compartment accessible through access port 18, contains rotatable shelves 36 and 38. Shaft 40 supports shelves 36 and 38 and facilitates their free manual rotation. A pair of shelves 42 and 44 are disposed supported on the innermost surface 46 of front lowermost door 16. Shelves 42 and 44 are adapted with curved outermost walls 48 and 50 having a curvature similar to that of the marginal edges 52 and 54 of shelves 36 and 38 respectively. When door 16 is closed, walls 48 and 50 reside adjacent to marginal edges 52 and 54 respectively. Slide-out trays 56, 58, and 60 are disposed within the lower compartment and may be removed therefrom by displacement in the direction of arrow 62. Tray 56 resides at a height adjacent to marginal edges 54. Tray 58 resides at a height adjacent to marginal edges 52. Tray 60 resides at a height level above marginal edges 52.

Figure 2:
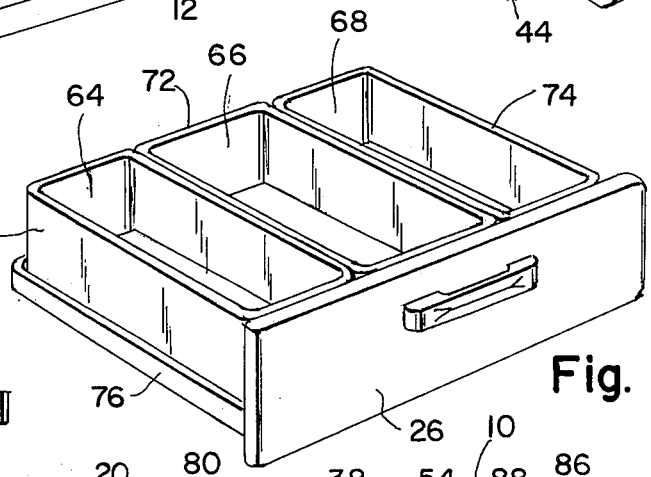
FIG. 2 is a perspective view of the drawer portion of the present invention.

FIG. 2 illustrates drawer 26 with separate compartments 64, 66, and 68, having open mouth portions available in the uppermost regions thereof. The compartments comprise removable trays 70, 72, and 74 respectively shown supported within drawer bottom 76. The drawer may be slidably affixed to housing 10, shown in FIG. 1, utilizing a plastic material such as a polyaminde material for the rollers in a glide mechanism.

Figure 3:
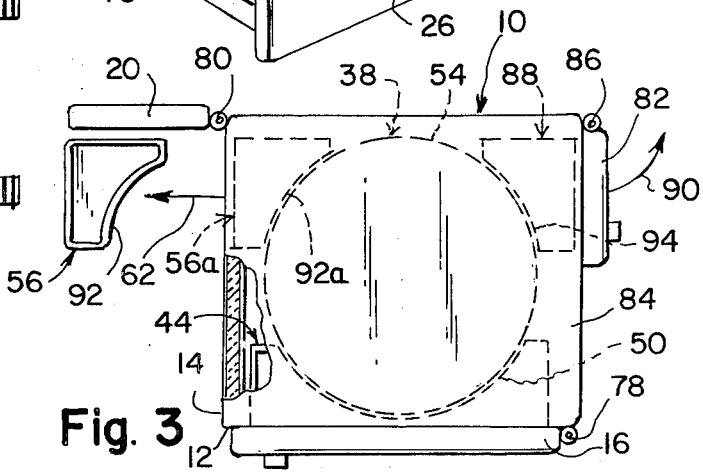
FIG. 3 is a plan view of the present invention.

FIG. 3 illustrates housing 12 having front door 16 hingably affixed to front panel 12 utilizing hinge 78 therefore. Side door 20 is secured to side panel 14, utilizing hinge 80. In similar fashion, side door 82 residing on another side surface 84, adjacent to frontmost surface 12, is hingably affixed thereto utilizing hinge 86. Circular shelf 38, shown in dotted lines, resides substantially in the center of the lowermost compartment. Pull out shelf 56*a*, shown in dotted lines, may be disposed outwardly, in the direction of arrow 62 to a position shown by pullout shelf 56. In similar fashion, pullout shelf 88, shown in dotted lines, may be removed from the interior confines of the lower compartment when door 82 is hingably disposed open in the direction of arrow 90. The marginal side wall 92 of pullout shelf 56 is shown as dotted lines 92*a* residing adjacent to marginal edges 54 of shelf 38. Similarly, the curved walls 94 of pullout shelf 88 reside adjacent the marginal edges 54 of rotating shelf 38. Curved walls 50 of shelf 44, shown in dotted lines, reside adjacent marginal edges 54 of shelf 38.

Figure 4:
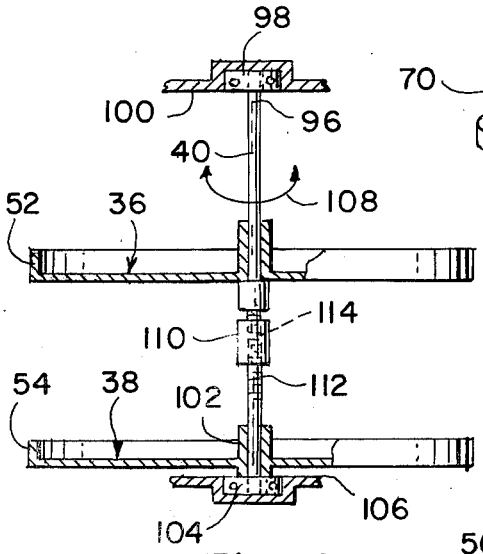
FIG. 4 is a side elevation view of the rotating shelves utilized in the present invention.

FIG. 4 illustrates shaft 40 supporting rotating shelf 36 and rotating shelf 38 therealong. The uppermost end 96 of shaft 40 resides in bearing 98 disposed within an uppermost lateral surface 100 of the lowermost compartment as shown in FIG. 1. The lowermost end 102 of shaft 40 resides in bearing 104 disposed within the floor 106 of the lowermost compartment as shown in FIG. 1. Shaft 40 may be manually rotated in the directions of arrows 108 and may be disassembled by unthreading nut 110 from threaded portions 112 and 114, permitting rotating shelves 36 and 38 to be removed from the interior of the lower compartment, shown in FIG. 1, for cleaning purposes.

One of the advantages is to provide a refrigerator having rotating circular shelves whose volumetric storage capacity closely approximates the overall volume of the refrigerator.

Another advantage is to provide a refrigerator with access doors on the sides thereof.

Still another advantage is to provide a refrigerator having a pull-out drawer portion which is useful for the storage of foods requiring close confinement, separated from other storage area of the refrigerator.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A refrigerator apparatus comprising a housing, said housing having a front panel, said housing having a pair of side panels in parallel spaced apart relationship adjacent said front panel, a first door hingably secured to said front panel, a second door hingably secured to one of said pair of side panels, a front access opening passing through said front panel, said front access opening disposed adjacent said first door when said first door is in a closed position, a side access opening passing through said one side panel, said side access opening disposed adjacent said second door when said second door is in a closed position, a compartment, said compartment disposed within said housing and accessible through said front access opening and said side access opening, a plurality of circular shelves disposed in overlying relationship to one another within said compartment, a shaft, said shaft rotatably supporting said plurality of circular shelves, a plurality of shelves fixedly secured to said first door, said plurality of shelves having circularly shaped wall portions affixed thereto, said circularly shaped wall portions residing adjacent portions of the marginal edges of said plurality of circular shelves when said first door is in said closed position, a plurality of pullout trays removably slidably secured within said compartment and totally removable from said compartment, said plurality of pullout trays being disposed passing through said side access opening when said second door is disposed in an open position relative to said side access opening, at least one of said plurality of pullout trays having curved wall portions affixed thereto, said curved wall portions residing adjacent portions of said marginal edges of at least one of said plurality of circular shelves.

2. The refrigerator apparatus as claimed in claim 1 wherein said housing has a third door hingably secured to the other of said pair of side panels, another side access opening passing through said other side panel, said another side access opening disposed adjacent said third door when said third door is in a closed position, said compartment accessible through said another side access opening, another plurality of pullout trays removably slidably secured within said compartment, said another plurality of pullout trays being disposed passing through said another side access opening, at least one of said another plurality of pullout trays having curved wall portions affixed thereto, said curved wall portions of said at least one of said another plurality of pullout trays residing adjacent portions of said marginal edges of said at least one of said plurality of circular shelves.

3. The refrigerator apparatus as claimed in claim 1 further comprising a drawer, said drawer slidably secured to said housing, said drawer being disposed passing through said front panel, a plurality of removable trays supported by the floor of said drawer, one of said plurality of removable trays having an open mouth portion disposed upwardly from said floor.

4. The refrigerator apparatus as claimed in claim 1 further comprising means to disassemble said plurality of circular shelves from one another for removal from said compartment.

5. The refrigerator apparatus as claimed in claim 3 wherein said drawer is disposed residing above said compartment.

6. The refrigerator apparatus as claimed in claim 1 further comprising a freezer compartment, said freezer compartment being disposed in the uppermost interior regions of said housing.

7. The refrigerator apparatus as claimed in claim 1 wherein said housing comprises exterior surface substantially disposed at right angles to one another.

* * * * *